United States Patent [19]

Endo et al.

[11] 4,353,960

[45] Oct. 12, 1982

[54] COMPOSITE AND CONJUGATE FILAMENTS

[75] Inventors: Hiroyuki Endo; Hiroshi Ohhira; Tohru Sasaki, all of Iwaki, Japan

[73] Assignee: Kureha Kagaku Kogyo Kabushiki Kaisha, Tokyo, Japan

[21] Appl. No.: 238,766

[22] Filed: Feb. 27, 1981

Related U.S. Application Data

[63] Continuation of Ser. No. 76,991, Sep. 19, 1979, abandoned.

[30] Foreign Application Priority Data

Sep. 21, 1978 [JP] Japan ..... 53-116130
Apr. 8, 1980 [JP] Japan ..... 55-46079

[51] Int. Cl.[3] ..... D02G 3/00

[52] U.S. Cl. ..... 428/373; 428/394; 428/395; 428/401; 428/902; 43/44.98; 264/171; 264/DIG. 26

[58] Field of Search ..... 428/373, 374, 378, 394, 428/395, 902, 401; 43/44.98; 264/171, 172, DIG. 26, 176 F

[56] References Cited

U.S. PATENT DOCUMENTS

| | | | |
|---|---|---|---|
| 3,316,336 | 4/1967 | Smith | 428/373 |
| 3,998,988 | 12/1976 | Shimomai et al. | 428/374 |
| 4,075,378 | 2/1978 | Anton et al. | 428/373 |
| 4,145,473 | 3/1979 | Samuelson et al. | 428/373 |
| 4,161,500 | 7/1979 | Schleinitz et al. | 428/373 |

OTHER PUBLICATIONS

Japanese Patent Publication Sho-44-5359.

*Primary Examiner*—George F. Lesmes
*Assistant Examiner*—Alexander S. Thomas
*Attorney, Agent, or Firm*—Fleit & Jacobson

[57] ABSTRACT

The invention provides improved composite and conjugate filaments to be used exclusively in in-water submerged purposes. Each of these filaments consists of a core of vinylidene fluoride resin consisting in turn of one or more filamentary element(s), while a sheath consists of polyamide resin. The composing ratio as measured between the cross-sections of these both resins is defined by a value extending from 1/99-to 40/60, preferably from 3/97 to 30/70, still more preferably between 3/97 and 20/80.

3 Claims, 4 Drawing Figures

COMPOSITE AND CONJUGATE FILAMENTS

CROSS-REFERENCE OF RELATED APPLICATION

This application is a Continuation-In-Part application, claiming Convention rights from Japanese Patent Application No. Sho-55-46079 filed Apr. 8, 1980 in Japan, and of our earlier co-pending Application Ser. No. 76,991 filed Sept. 19, 1979, now abandoned by the same inventors, under claiming Convention rights from Japanese Patent Application No. Sho-53-116130 filed Sept. 21, 1978 in Japan.

BACKGROUND OF THE INVENTION

This invention relates to novel composite and conjugate filaments adapted highly and exclusively for use in in-water submerged state services and providing superior and improved dynamic impact strength, water-resisting and anti-friction performancies.

As is well known, polyamide filaments represent superior tensile strength, knot strength, modulus of elasticity and antifriction performance and highly suitable for use in in-water submerged services, especially as fishing lines, fishing nets and marine ropes. Although the polyamide filaments show still superior antifriction performance in contact with water, because they absorb a certain amount of water and become rather soft and pliable, while they are subjected to elongation in length and substantial reduction in strength.

When a polyamide fishing line is used for fishing purposes, and a large fish bites, a substantial tensile impact will be applied to the fishing line which is however rather poor to the fish-on shocks in the water-submerged state. Similar and even accentuated and repeated impacts may be applied to a moorage rope composed of a large number of polyamide fibers which are rather weak in tensile strength when subjected to continued contact with water. Therefore, much is desired to improve the tensile shock impact resistance of these lines and ropes.

It was already proposed by Kureha Kagaku Kogyo Kabushiki Kaisha, Tokyo, Japan, the assignee company of the present application, in Japanese Patent Publication No. Sho-44-5359, to provide fisherman's lines and ropes made of polyvinylidene fluoride. These fishing lines have been manufactured and sold by the said assignee company under the trade name of "Seager" and "Max" and acquired favorable criticism among those skilled in the art. These PVDF-filaments represent substantially higher tensile strength as well as knot strength than polyamide filaments and it has been found that these superior values will be subjected to almost no reduction even in the in-water service conditions. Therefore, in the fishing and the like in-water services, the PVDF-filament shows substantially superior performance in this respect over the corresponding denier polyamide filament, while the former represents rather lesser elongation rate in the water. It should also be stressed that the PVDF-filament has several times higher impact strength than the corresponding polyamide filament.

On the other hand, it has been observed that the antifriction performance of PVDF-filaments is slightly lesser than that of polyamide one, thus turbo-flies being generated in contact with a rocky edge or the like and the former being subject to breakage under certain conditions.

SUMMARY OF THE INVENTION

It is therefore an object of the present invention to provide an improved composite and conjugate filament showing superior physical properties adapted for use in marine and in-water services over those of the corresponding polyamide and PVDF filaments.

This and further objects, features and advantages will become more apparent from the detailed description of the invention to be set forth occasionally with reference to the accompanying drawings, in which:

ESSENCE OF THE INVENTION

Figure 1:
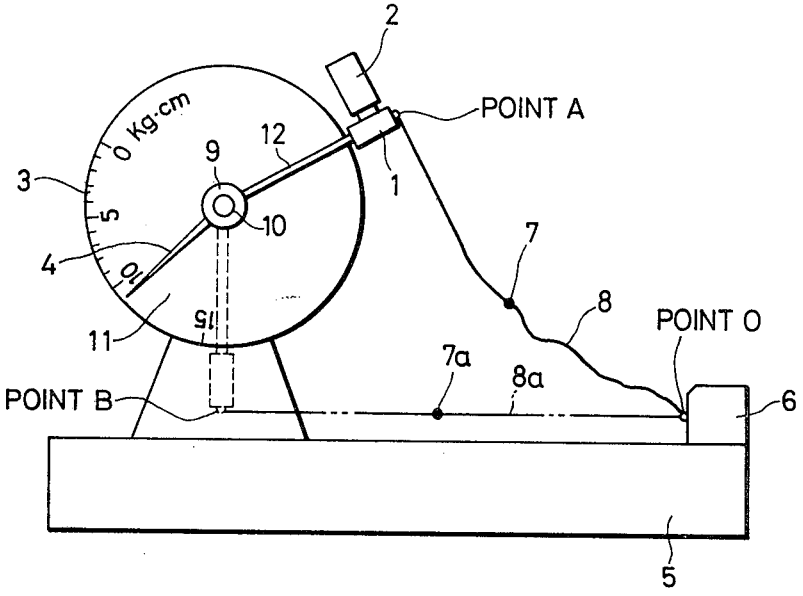
FIG. 1 is a schematic sketch of an impact strength measuring unit usable in the present invention.

The inventive basic technical idea resides in the composite and conjugate combination of polyamide with polyvinylidene fluoride, so as to substantially obviate the inherent defects of the both kinds filaments if these have been separately spun into respective filaments.

For satisfying the above and other objects, the composite filament has such a core element comprising one or more vinylidene fluoride filamentary elements, while the said core filament or filaments is/are surrounded by a sheath composed of polyamide. It will be easily seen, as practically assured, that the composite and conjugate fiber represents substantially similar antifriction loss performance with that of polyamide resin, since the composite filament has the sheath made of polyamide. Even in such case of the present invention that the core represents only 5% of vinylidene fluoride filament or filaments based upon the whole cross-sectional area of the composite fiber and thus substantial amount, 95% or so, as an example, of the whole material is composed of polyamide, the overall impact srength becomes as high as nearly two fold of that of the exclusively polyamide-made filament. It is rather surprising that the impact strength of the composite filament even in the above case amounts under the in-water dipped state even to nearly 2.5 fold of that of the corresponding but exclusively polyamide-made filament.

Further, it should be stressed that the elongation rate appearing in the water can be substantially improved in the case of the inventive composite, conjugate filament over the conventional exclusively polyamide-made fibers, which fact may provide a remarkable progress in the art.

The composite, conjugate filament adapted for use in the in-water submerged service, comprises a core element composed of one or more filamentary elements of vinylidene fluoride resin and a sheath element surrounding the said core element of polyamide resin, the composing ratio between said both core and sheath representing 1/99–40/60 when expressed in the cross-sectional ratio. It is understood that hereinafter references to ratios, such as 40/60 are meant to refer to the cross-sectional area ratio between the core and sheath respectively.

The reason for the selection of the core vinylidene fluoride resin to be 40% or less of the total mass of the composite filament in the above mentioned way resides in such observation that an adoption of still higher vinylidene fluoride core component may likely lead to disadvantageous occurence of interlayer separation between the core and sheath with occasional application of substantial impact stresses to the composite filament. On the other hand, the selection of the core vinylidene fluoride at 1% or higher is based on the observation of such a fact that with lesser amount of the core vinylidene fluoride, the physical properties of the composite filament will become nearer to those of the exclusively polyamide resin-made filament, thus the composing effect as provided by the present invention being liably to lose.

It has been observed that the knot strength of the inventive composite filament represents an inverted peak at a selected composing ratio: 50/50 according to our practical experiments and that with increased composing ratio over the above specific ratio, the knot strength is likely to decrease. Therefore, it can be said that such a composing ratio of 3/97–30/70 is rather recommendable. Still further recommendable composing ratio will be less than 20/80 when taking consideration of the higher price of vinylene fluoride resin.

By the term "vinylidene fluoride" or "-resin" as used herein and in the appended claims is meant by vinylidene fluoride polymer and -co-polymer, the latter including however 90 wt.% or more of vinylidene fluoride monomer. Such polymer or co-polymer may include less than 10 wt.% of one or more of other kind(s) of resin(s) mutually soluble with the said polymer or co-polymer, conventional plasticizer; stabitizer; pigment; crystal core-forming agents and/or additives.

As the co-polymerizable monomer, fluorine-containing monomer may be highly recommended in consideration of its high thermal stability. As an example, vinyl fluoride; fluorochlorovinylidene; trifluoroethylene; monochlorotrifluoroethylene; hexafluoropropylene and the like.

As for the vinylidene polymer or -co-polymer, it should be mentioned that with higher the polymerization degree, the filament will have higher tensile strength, and thus, the intrinsic viscosity $\eta$inh (serving naturally as a measure of the polymerization degree) must be higher, so far as the meltextrusion is not disturbed.

Generally speaking, the intrinsic viscosity may preferably be within such a range of 0.7–1.8 dl/g at 30 deg. C. as observed when the resin is dissolved in dimethyl formaldehyde solvent in a ratio of 0.4 g/dl.

As for the polyamide resin usable in the present invention, homopolyamide or copolyamide may be used. A proper amount of other mutually soluble resin; conventional plasticizer; stabilizer; pigment; crystal core-forming agent; additive(s) may be admixed with the polyamide resin. In any case, however, it is preferable to use the polyamide resin included at 90 wt.% or still higher.

As for the polyamide usable in this invention, polycapramide, polyhexamethylene adipamide, polyhexamethylene sebacamide or the like, comprising mainly alkylene polyamide carrying less than 10 methylene radicals per amido-radical, is highly recommendable to use.

In this case, upon occasion, part of the alkylene radical may be replaced by aromatic radical. As for the relative viscosity, its range may preferably be 2.4–4.0 when measured with 1.0 wt.% solution of the polyamide in 98%-sulfuric acid.

For the formation of the composite, conjugate filament(s), reliance can be made on the conventional conjugate extrusion process. Briefly, the core material vinylidene fluoride resin and the sheath material polyamide resin are thermally fused and extruded from respective extruders through a composite extrusion nozzle unit in such a way that the sheath resin material concentrically surrounds the core resin material, so as to provide a composite, conjugate filament. The core nozzle part of the unit may have a plurality of nozzle elements.

The thus extruded composite filament is then quenched in a cold water or aqueous solution bath and the subjected to stretching in one or more successive stretching stages under heat. Finally, the stretched composite filament is subjected to a heating stage for fixing the molecular orientation. Generally speaking, the overall stretch factor may amount to 3–8.

Before setting forth a preferred number of numerical examples, our method for the measurement of impact (knot) strength will be explained.

The measurements were executed on an impact strength tester manufactured and sold by Sankyo Seiki Kogyo Kabushiki Kaisha, Tokyo, Japan, under the trade name of "Dynstat". This tester has been designed for the measurement of strength of sheet form test pieces, and its general structure is seen from FIG. 1.

In this figure, numeral 1 represents an impact hammer which is rotatable around a stationary shaft 10 through a supporting arm 12.

Numeral 2 denotes a stationary electromagnet having an energizing circuit including a d.c. power source and an on-off switch, although not shown.

Before starting a test experiment, the electromagnet 2 is energized so as to position and hold the hammer 1 at a predetermined point A, while the latter is held at its vertically suspended off-service position at point B as shown in dotted line shown in FIG. 1, when the magnet is deenergized.

When the hammer 1 is freed from position A by deenergization of magnet 2, the former will be rotated by gravity action together with its bearing ring 9 until the latter points 0-mark cut on a stationary scale disk 11 which is rigid with stationary shaft 10. The pointer 9 is frictionally rotatable around the shaft 10. In this case, the pointer will arrive just at the 0-point by being pushed forward to that point by the final rising movement of the hammer.

A filamentary test specimen is shown at 8 in FIG. 1, one end of the filament being attached fixedly to the hammer as shown. The opposite end of the filament 8 is fixedly attached to a stationary point 0 provided on a pedestal 6 fixedly mounted on the stationary bed 5 of the tester.

The length of the filament 8 has been so selected that when the hammer 1 is freed and correctly vertically suspended, the filament is just tensioned as shown in chaindotted line.

Numeral 7 denotes a knot formed on the filament 8, while the corresponding knotted point is shown at 7*a* on the previously tensioned filament 8*a*.

For initiation of the knot strength test, the hammer 1 is freed by deenergizing the holding magnet 2. Then, the hammer will rotate clockwise in FIG. 1 and stop at an intermediate point shown by way of example by the full-lined pointer 4 indicating a scale point 11 kg-cm or so on the indicating scale 3 cut at the peripheral zone on disk 11.

During the clockwise and further rotation of the hammer across the point B, the filament will naturally break, upon impressing a counter impact upon the hammer which corresponds to the breaking strength of the filament 8. In this way, the required knot impact strength of the filament can be measured reliably and in the simplest way. The real value must be naturally decided by dividing the thus measured value by the cross-sectional area of the filament. Since, generally speaking, the impact stress of the filament under test is least at the knotted point 7 or *7a*, the required measurement is enough for practical purposes.

As may be well supposed, the composite filaments prepared according to this invention are highly suitable for filtering material, nets, ropes, fishing lines, guts. In addition, these are also highly superior for use as the optical fibers.

EXAMPLE 1

A thick acid solution of PVDF, having $\eta_{inh}$:1.30 dl/g (measured at 25° C.) and manufactured and sold by Kureha Kagaku Kogyo K.K., Tokyo, Japan, under the trade name of "KF-Polymer, #1,300" in 96%-sulfuric acid in the ratio of polymer 1 g in 100 dl of sulfuric acid, and 6-nylon (manufactured and sold by Unitica K.K. (Tokyo, Japan) under the trade name "A 1030 MT", relative viscosity:3.70 (measured at 25° C.) were extruded through 32 mmϕ extrusion nozzles at 285 and 260 deg. C., respectively, and then through a core-sheath composite die into a composite sheath-core conjugate fiber. The sheath consisted of 6-nylon, while the core is composed of PVDF. The melt-spun products were extruded into a water bath kept at 5 deg. C., then stretched to a five times length in an oil bath kept at 170 deg. C. Further conjugate filament was subjected simultaneously to a slight stretch to 1.05 times length and thermally fixed into its stabilized state by passing through a hot oil bath kept at 180 deg. C. Finally, the filament was passed through a hot air stream, 190° C., so as to bring a 10%-length release. In this way, a transparent, glazing and tough conjugate filament, 340μϕ, was obtained.

Figure 2:
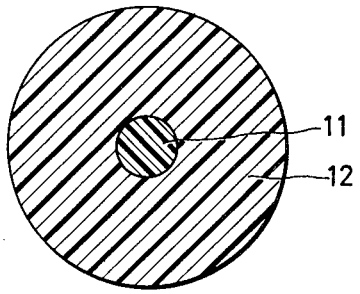
FIG. 2 is an enlarged schematic cross section of a composite annd conjugate filament prepared in accordance with the present invention, Example 1, to be set forth.

The overall cross-section of the thus prepared conjugate filament is shown in FIG. 2, showing its outer peripheral layer or sheath 12 formed of polyamide resin and its core 11 formed of PVDF. The composition ratio, represented by cross-sectional ratio of PVDF/6-nylon amounted to 5/95. Its tensile strength:75 kg/mm$^2$; tensile initial Young modulus:245 kg/mm$^2$1 knot strength:58 kg/mm$^2$; and impact (knot) strength:250 kg-cm/mm$^2$. Further, its specific gravity amounted to 1.18 and its sinking time for 22 cm water depth measured in a water tank amounted to 11 seconds.

Upon dipping in a water bath, 25 deg. C., for 24 hours, the corresponding physical properties were such as tensile strength:71 kg/mm$^2$, tensile initial Young modulus:125 kg/mm$^2$; knot strength:53 kg/mm$^2$, and impact strength:220 kg-cm/mm$^2$.

Then, weight suspension tests were carried out for determining the creep rate.

Figure 3:
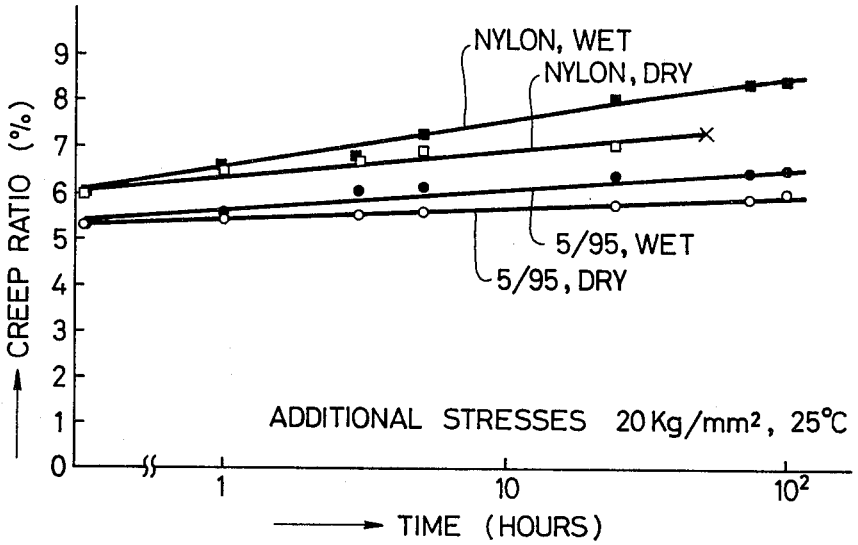
FIG. 3 is a chart showing comparative tests of conventional and inventive filaments, showing creep characteristics.

At first, a weight of 1.6 kg was suspended from the lower end of a length, 40 cm (the tensile stress being thus 20 kg/mm$^2$), and the corresponding creep ratios were measured in the atmospheric air and in a water bath. In the similar way, 6-nylon filaments were tested in the similar way. The results are shown in FIG. 3, from which it will be clearly seen that the creeps of the said composite filament are substantially lower than those of 6-filament.

Figure 4:
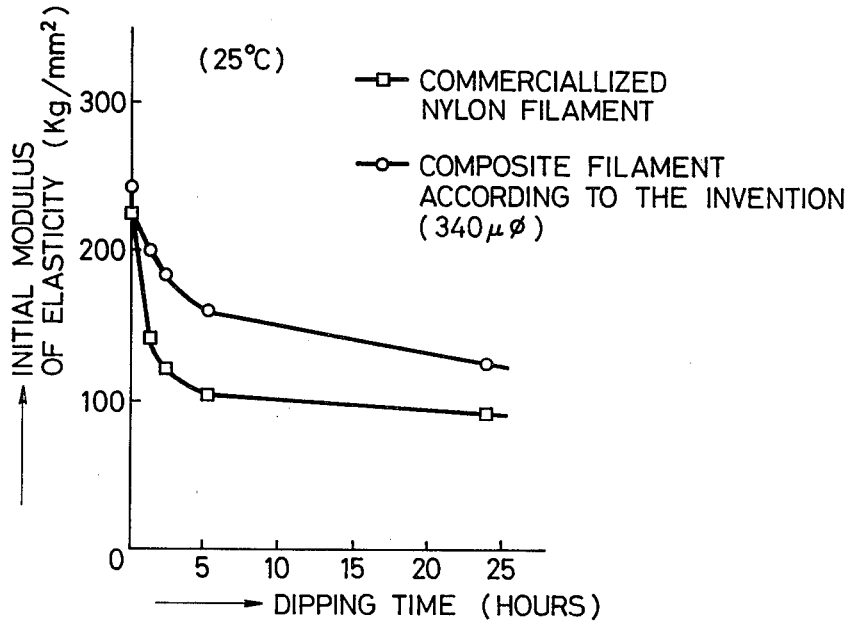
FIG. 4 is a chart showing variations in certain time period of initial elastic ratio in function of dipping time in water.

Then, initial Young modulus was measured on the composite as well as 6-nylon filaments upon dipped in a water bath and hourly during the dipping. These results are shown in FIG. 4. from which it will be easily seen that the reducing rate of the composite filament in the water is rather lesser in comparison with the 6-nylon filament.

It is an astonishing fact that by replacing only 5% or so of the filament cross-section of 6-nylon by PVDF, the corresponding main physical properties in water, such as impact strength, initial Young modulus and elongation can be substantially improved, especially when considering the corresponding simple arithmetic values as being found by calculation from dry and wet impact strength values of nylon- and PVDF-filaments amount only to 145 kg-cm/mm$^2$ (dry) and 107.5 kg-cm/mm$^2$ (wet) respectively.

Further, the composite filament was tested by applying practically normal repeated stress:20 kg/m$^2$, thereon, indeed, at 500 times. However, no separation phenomenon of the sheath from the core has been found.

COMPARATIVE EXPERIMENT 1

6-nylon resin was melt-extruded from a single orifice, under the same operating conditions as in the foregoing Example 1, the resulted yarn was then successively stretched and heattreated as explained therein. In this way, a transparent and glazing yarn, 340μϕ, of 6-nylon was obtained.

As main characterizing physical properties of this yarn, the following results were measured:

| | |
|---|---|
| Tensile strength: | 78 kg/mm$^2$; |
| Tensile initial Young's modulus: | 225 kg/mm$^2$; |
| Knot strength: | 62 kg/mm$^2$; |
| Impact (knot) strength: | 130 kg-cm/mm$^2$; |
| Specific gravity: | 1.15. |
| Water sinking time for 22 cm depth: | 17 seconds. |

Further, upon immersion of this yarn for 24 hours, the following results were found:

| | |
|---|---|
| Tensile strength: | 68 kg/mm$^2$; |
| Initial Young modulus: | 95 kg/mm$^2$; |
| Knot strength: | 50 kg/mm$^2$; |
| Impact (knot) strength: | 90 kg-cm/mm$^2$; |

Thus, considerable reductions were experienced.

COMPARATIVE EXPERIMENT 2

PVDF resin same as was used in the Example 1 was solely used for melt spinning and under same conditions as in Comparison Experiment 1, so as to provide a PVDF yarn, 340μϕ.

Main physical data of this yarn were as follows:

| | |
|---|---|
| Tensile strength: | 75 kg/mm$^2$; |
| Tensile initial Young nodulus: | 305 kg/mm$^2$; |
| Knot strength: | 64 kg/mm$^2$; |
| Impact (knot) strength: | 440 kg/mm$^2$; |
| Specific gravity: | 1.79. |

The corresponding values of the yarn did not go down in the water bath test of dipping.

EXAMPLE 2

The same PVD-polymer as employed in Example 1, 100 wt. parts, was used and mixed with polyester plasticizer 3 wt. parts, for providing the core material of the composite filament scheduled. On the other hand, an acid solution of 6-nylon (manufactured and sold by Unitica Ltd., Tokyo, under the trade name of "A 1030 MF", having a relative viscosity 3.4 at 25 deg. C. as determined by dissolving the resin in 96%-sulfuric acid in the ratio of polymer 1 g/sulfuric acid 100 dl, was used as the sheath material. These both materials were melt-spun by use of a composite spinning die into a water bath, 5 deg.C., then quenched and successively stretched to 4.5-times length in hot oil bath of 165 deg. C. The sheath-core composite filament was stretched to a 1.1-times length in oil bath of 176 deg. C. and released by 10% in dried hot air atmosphere of 190 deg. C. In this way, a transparent and glaze composite filament was produced.

By use of correspondingly different composite dies, similar composite filaments of various composition ratios:10/90; 15/85; 20/80; 30/70; 40/60; 50/50; 80/20 and 90/10 were obtained. Specific gravities, sheath-core separation, strengths and Young modii were measured as seen in Table 1.

As will be clear from the foregoing, no separation between the nylon and PVDF-layers did occur during the tensile breakage of the composite filament, so long as the composing ratio PVDF/nylon remains from 1/99 to 40/60.

EXAMPLE 3

With a core prepared from a co-polymer ninh being 1.20 dl/g comprising vinylidene fluoride resin, and chlorotrifluoroethylene in a ratio of 95:5, is conjugated a sheath of nylon 6, relative viscosity:3.7 (manufactured and sold by Unitica Ltd., Tokyo, under the trade name of "A 1030 BRT), as in the similar manner as was disclosed herein in Example 5, and then the thus extruded composite filament was quenched in a water bath, 5 deg. C.

This unstretched and quenched composite filament was firstly stretched to a 4.1 times length in steam atmosphere of 165 deg. C. and secondly to a 1.10 times length in steam atmosphere of 170 deg. C. and finally subjected to a 8%-relaxation in dried air atmosphere kept at 180 deg. C.

The diameter of the composite filament thus spun and after-treated amounted to 320$\mu$.

The composing core/sheath cross sectional area ratio was selected at 7/93. Specific gravity:1.20; Knot impact strength:240 kg-cm/mm$^2$; Tensile strength:68 kg/mm$^2$. This filament shown superior glossy and transparent characteristics.

EXAMPLE 4

PVDF polymer, $\eta_{inh}$:1.10 dl/g (manufactured and sold by Kureha Kagaku Kogyo K.K., Tokyo, Japan under the trade name of "KF-polymer #1100), Was used as the core, while 6-nylon, relative viscosity 3.7 as determined with a solution of polymer 1 g in 100 dl of 96%-sulfuric acid at 25 deg. C., was used as the sheath material. The composing procedure was same as before.

The conjugatingly spun composite filament was quenched and then subjected to a stretch amounting to a 3.7 times length in a heated air atmosphere at 170 deg. C. by use of an infrared ray heater. The composite filament was subjected to a further stretch to a 1.15 times length in a similar heated air atmosphere at 185 deg. C. again by infrared heater. Then, the composite filament was released by 15% in a heated air atmosphere at 220 deg. C. by an infrared ray heater.

The filament diameter amounted to 380$\mu$. The transparent and glazing characteristics were superior.

The composing core/sheath cross sectional area ratio was 10/90. Specific gravity was 1.20; Knot strength:42 kg/mm$^2$; impact (knot) strength:260 kg-cm/mm$^2$; tensile strength:62 kg/mm$^2$.

Upon application of repeated stresses (20 kg/mm$^2$×500 times), this composite filament did not show any interlayer separation.

TABLE 1

Main Physical Data of Composite Filaments

| Probe Composing Ratio: PVDF/Nylon | | Tensile Strength, kg/mm$^2$ | Initial Young Modulus, kg/mm$^2$ | Knot Strength, kg/mm$^2$ |
|---|---|---|---|---|
| 0/100 | (before water dip) | 78 | 225 | 62 |
| | (after water dip) | 68 | 95 | 50 |
| 5/95 | (before water dip) | 75 | 245 | 58 |
| | (after water dip) | 71 | 125 | 53 |
| 10/90 | | 75 | 255 | 55 |
| 15/85 | | 72 | 260 | 52 |
| 20/80 | | 71 | 265 | 52 |
| 30/70 | | 69 | 265 | 50 |
| 40/60 | | 67 | 270 | 48 |
| 50/50 | | 63 | 275 | 43 |
| 60/40 | | 66 | 275 | 45 |
| 80/20 | | 68 | 280 | 50 |
| 90/10 | | 69 | 285 | 56 |
| 100/0 | | 75 | 305 | 64 |

| | | Impact Strength, kg-cm/mm$^2$ | Specific Gravity | Sheath Separation Remarks | Ref. |
|---|---|---|---|---|---|
| 6/100 | (before water dip) | 130 | 1.15 | none | Comp. Exp. 1 |

TABLE 1-continued

| | | | | | | |
|---|---|---|---|---|---|---|
| | (after water dip) | 90 | 1.14 | | | |
| 5/95 | (before water dip) | 250 | 1.18 | none | Example 1 | |
| | (after water dip) | 220 | 1.17 | | | |
| 10/90 | | 245 | 1.21 | none | Inventive | Example 2 |
| 15/85 | | 310 | 1.25 | none | | |
| 20/80 | | 310 | 1.27 | none | | |
| 30/70 | | 320 | 1.34 | none | | |
| 40/60 | | 320 | 1.41 | none | | |
| 50/50 | | 360 | 1.47 | slight | Comp. Exp 1 | Example 2 |
| 60/40 | | 370 | 1.53 | slight | | |
| 80/20 | | 400 | 1.66 | observed | | |
| 90/10 | | 400 | 1.72 | observed | | |
| 100/0 | | 440 | 1.79 | — | Comp. Expl. 2 | |

The embodiments of the invention in which an exclusive property or privilege is claimed are as follows:

1. A composite filament for use in in-water submerged services, said filament comprising a core and a sheath surrounding the latter, said core comprising one or a plurality of core filamentary elements(s) made of vinylidene fluoride resin and said sheath being composed of polyamide resin the composing ratio as measured in respective cross-sectional areas of said vinylidene fluoride resin and said polyamide resin being specified within the range from 1/99 to 40/60.

2. The composite filament as set forth in the foregoing claim 1 wherein said composing ration is in such a range extending from 3/97 to 30/70.

3. The composite filament as set forth in the foregoing claim 1 wherein the said composing ratio resides in such a range extending from 3/97 to 20/80.

* * * * *